US005954275A

United States Patent [19]

Honma et al.

[11] Patent Number: 5,954,275

[45] Date of Patent: Sep. 21, 1999

[54] ROTARY ATOMIZING ELECTROSTATIC COATING APPARATUS

[75] Inventors: Kengo Honma, Tokai; Isamu Yamasaki, Toyota, both of Japan

[73] Assignee: Toyota Jidosha Kabushiki Kaisha, Toyota, Japan

[21] Appl. No.: 08/840,273

[22] Filed: Apr. 14, 1997

[30] Foreign Application Priority Data

Apr. 2, 1997 [JP] Japan ..... 9-083503

[51] Int. Cl.[6] ..... B05B 3/10; B05B 5/00

[52] U.S. Cl. ..... 239/700; 239/223

[58] Field of Search ..... 239/223, 224, 239/290, 293, 300, 428.5, 703, 700

[56] References Cited

U.S. PATENT DOCUMENTS 4,200,232 4/1980 Fraley et al. ..... 239/240
4,572,437 2/1986 Huber et al. ..... 239/223 X
4,792,094 12/1988 Tachi et al. ..... 239/224 X
5,676,756 10/1997 Murate et al. ..... 239/223 X
5,697,559 12/1997 Davis et al. ..... 239/224 X

FOREIGN PATENT DOCUMENTS 7-24367 1/1995 Japan .

*Primary Examiner*—Kevin Weldon
*Attorney, Agent, or Firm*—Pillsbury Madison & Sutro LLP

[57] ABSTRACT

A rotary atomizing electrostatic coating apparatus includes a plurality of shaping air nozzles disposed on a first circle having its circle center on an axis of rotation of an atomizing head, a plurality of pattern control air nozzles disposed on a second circle having a larger diameter than the first circle. The pattern control air nozzles are located at 3–100 mm on a rear side of the shaping air nozzles and inside a circle having a diameter three times a diameter of the atomizing head. An air passable opening may be formed radially between the shaping air nozzles and the pattern control air nozzles.

11 Claims, 5 Drawing Sheets

ROTARY ATOMIZING ELECTROSTATIC COATING APPARATUS

This application is based on Japanese Patent Applications HEI 8-92845 filed in Japan on Apr. 15, 1996, HEI 9-57921 filed in Japan on Mar. 12, 1997, and HEI 9-83503 filed in Japan on Apr. 2, 1997, the contents of which are incorporated into the present application by reference.

BACKGROUND OF THE INVENTION

1. Field of the Invention

The present invention relates to a rotary atomizing electrostatic coating apparatus of the type capable of controlling a shaping air flow pattern.

2. Description of Related Art

Japanese Patent Publication No. HEI 7-24367 discloses a rotary atomizing electrostatic coating apparatus of the type capable of controlling a shaping air flow pattern. In the apparatus, as illustrated in FIGS. 8 and 9, shaping air nozzles 6' are arranged on a first circle having its circle center on an axis of rotation of a rotary atomizing head, and pattern control air nozzles 7' are arranged on a second circle having a larger diameter than the first circle. Each shaping air nozzle 6' has a nozzle axis inclined from a line parallel to an axis of the rotary atomizing head so that the shaping air flow pattern is spread in a direction away from the shaping air nozzles. The air expelled from the pattern control air nozzles 7' collides with the shaping air flow pattern and changes the pattern.

Since the shaping air is expelled from the nozzles at a high speed, the shaping air flow draws air around the flow to generate a secondary flow (accompanying air flow). It is important that the secondary flow freely accompany the shaping air flow without generating turbulence or a vortex so that a smooth shaping air flow is formed.

However, in the conventional apparatus, since the pattern control air nozzles are disposed radially outside the arrangement of the shaping air nozzles, free generation of the accompanying air flow is obstructed, producing a negative pressure adjacent the shaping air nozzles, causing vortices or turbulence V (FIG. 8) to be generated. As a result, atomized paint around the vortices is drawn to the region and in turn attaches to the atomizing head and the shaping air cap. Further, when the pattern control air is being expelled, the amount of the main air flow increases so that the negative pressure and the air turbulence are enhanced to draw more paint particles. The paint particles which adhere to the atomizing head and the air cap drop onto the body to be coated to degrade the coating quality.

SUMMARY OF THE INVENTION

An object of the present invention is to provide a rotary atomizing electrostatic coating apparatus that can form a shaping air flow generating almost no vortices or turbulence therearound.

To achieve the above-described object, in a rotary atomizing electrostatic coating apparatus according to the present invention where shaping air nozzles are arranged on a first circle having its center on an axis of rotation of an atomizing head and pattern control air nozzles are arranged on a second circle having a larger diameter than the first circle of the shaping air nozzles, the pattern control air nozzles are located in the range of 3 mm to 100 mm on a rear side of the shaping air nozzles in an axial direction of the atomizing head and inside a circle having a diameter three times a diameter of the atomizing head in a radial direction of the atomizing head.

Further, an opening for permitting air to pass therethrough may be provided to the rotary atomizing electrostatic coating apparatus radially between the first circle and the second circle.

In the above-described apparatus, since a configuration of an air cap is optimized due to the locational relationship between the shaping air nozzles and the pattern control air nozzles, a flow accompanying the shaping air flow is generated smoothly around the shaping air flow so that generation of vortices is effectively suppressed and adhesion of atomized paint drops onto the air cap is effectively prevented.

Further, in the case where the opening is formed, air is smoothly introduced to a space between the shaping air nozzles and the pattern control air nozzles from the rear side through the opening, so that despite the provision of the pattern control air nozzles, a flow accompanying the shaping air flow is generated smoothly around the shaping air flow. As a result, generation of vortices is effectively suppressed and adhesion of atomized paint drops onto the air cap is effectively prevented.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 1:
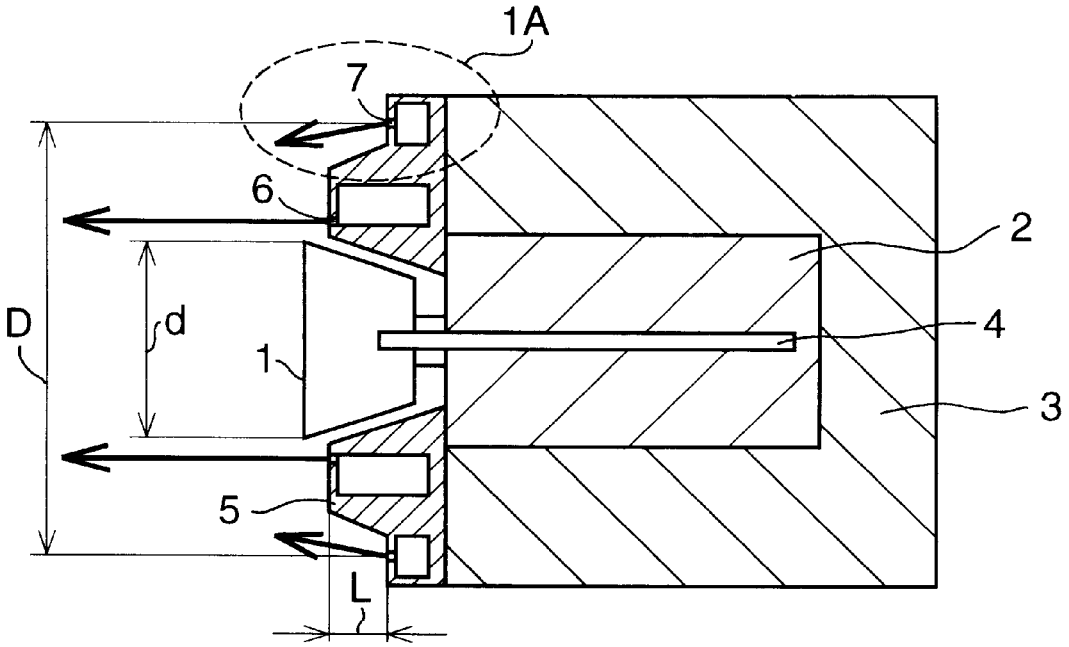
FIG. 1 is a schematic cross-sectional view of a rotary atomizing electrostatic coating apparatus according to a first embodiment of the present invention.
Figure 1A:
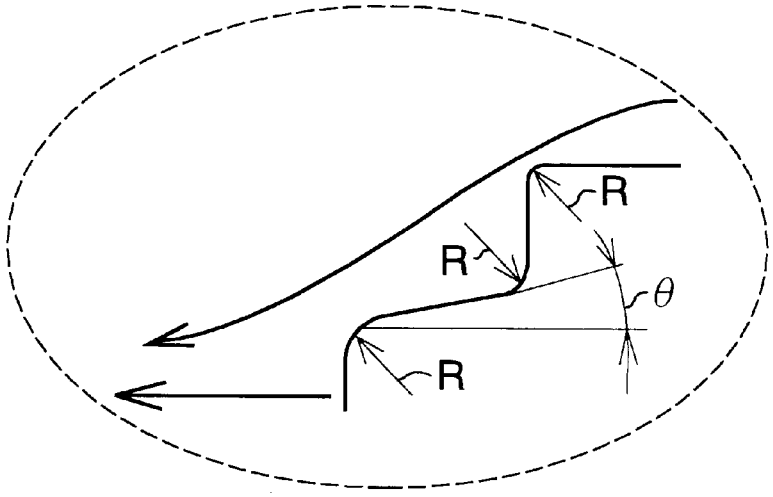
FIG. 1A is a partial view of FIG. 1.
Figure 2:
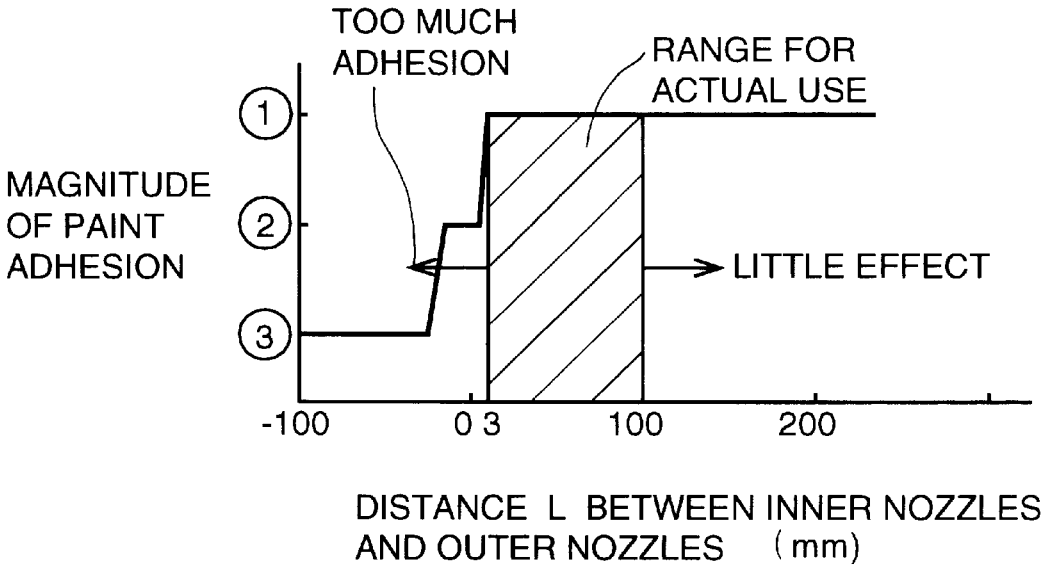
FIG. 2 is a graph illustrating a relationship, obtained in tests, between a magnitude of paint adhesion to a cap and head and an axial distance between inner nozzles (shaping air nozzles) and outer nozzles (pattern control air nozzles)
Figure 3:
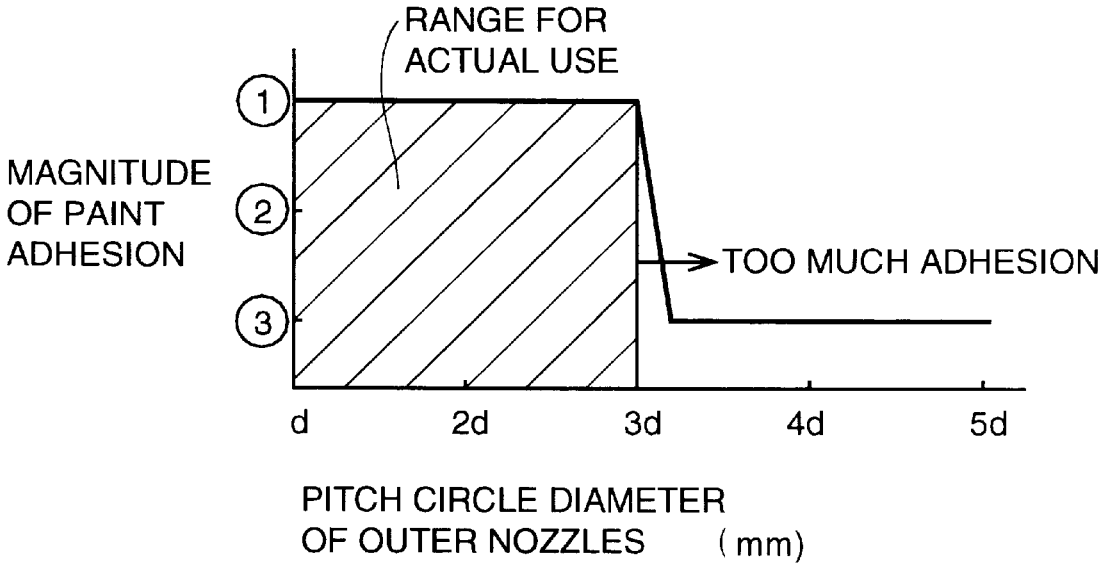
FIG. 3 is a graph illustrating a relationship, obtained in tests, between a magnitude of paint adhesion to a cap and head and a diameter of a circle on which the outer nozzles are arranged.
Figure 4:
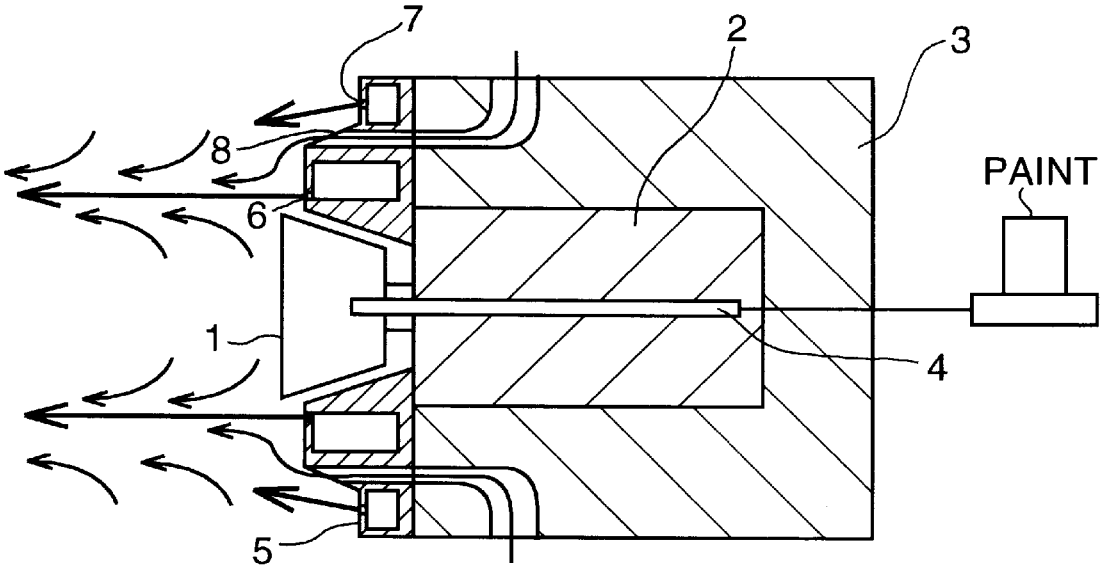
FIG. 4 is a schematic cross-sectional view of a rotary atomizing electrostatic coating apparatus according to a second embodiment of the present invention.
Figure 5:
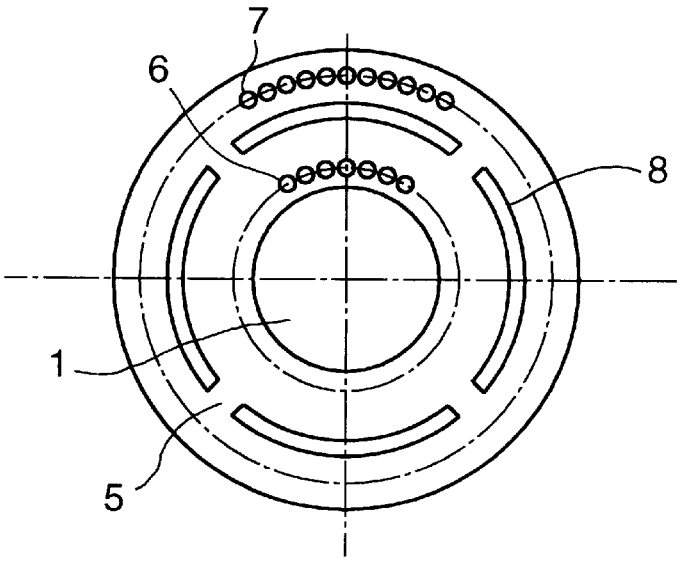
FIG. 5 is a front elevational view of the apparatus of FIG. 4.
Figure 6:
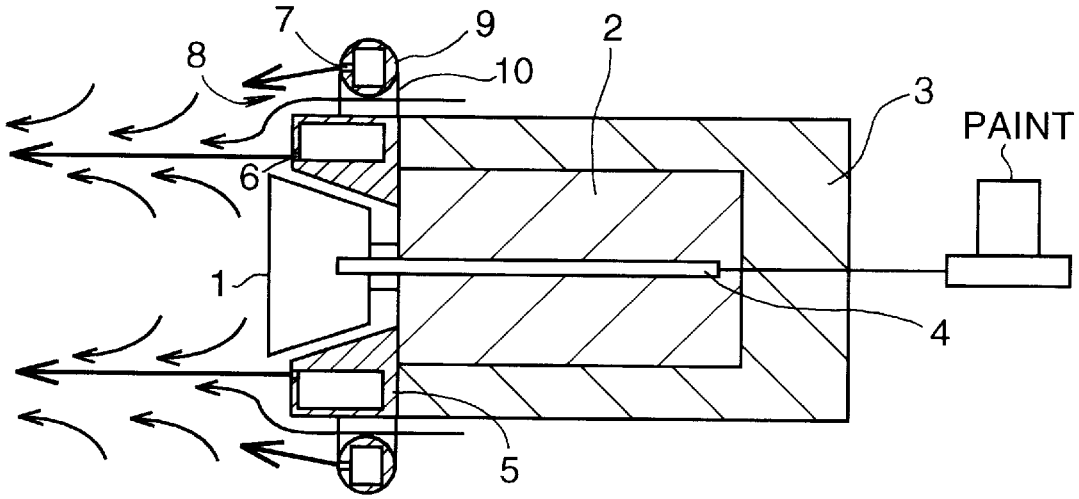
FIG. 6 is a schematic cross-sectional view of a rotary atomizing electrostatic coating apparatus according to a third embodiment of the present invention.
Figure 7:
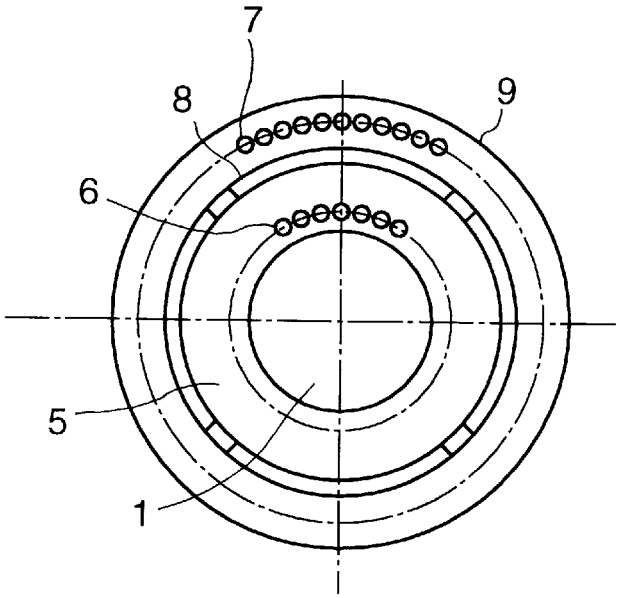
FIG. 7 is a front elevational view of the apparatus of FIG. 6.
Figure 8:
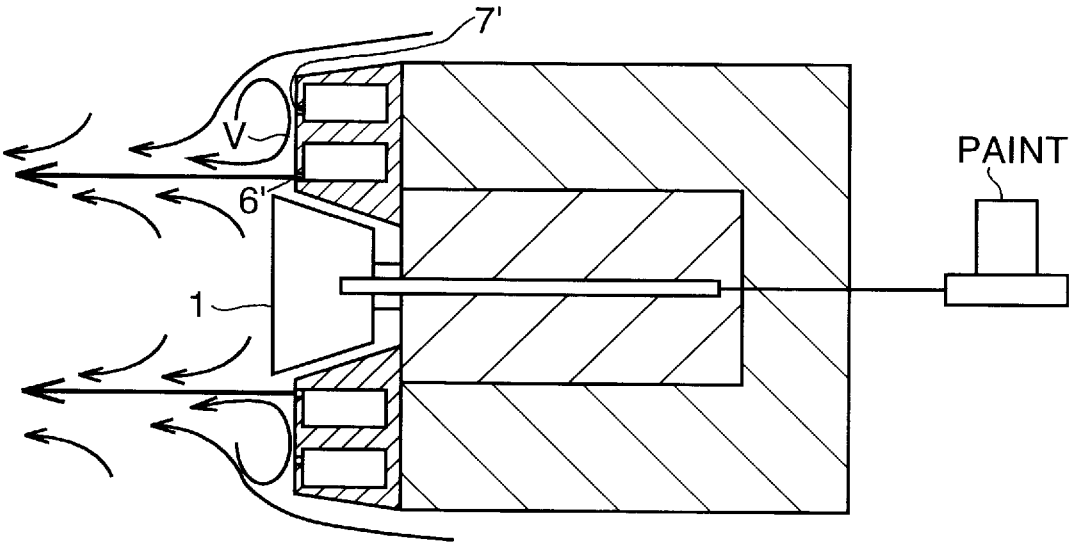
FIG. 8 (PRIOR ART)
FIG. 8 is a schematic cross-sectional view of a conventional rotary atomizing electrostatic coating apparatus.
Figure 9:
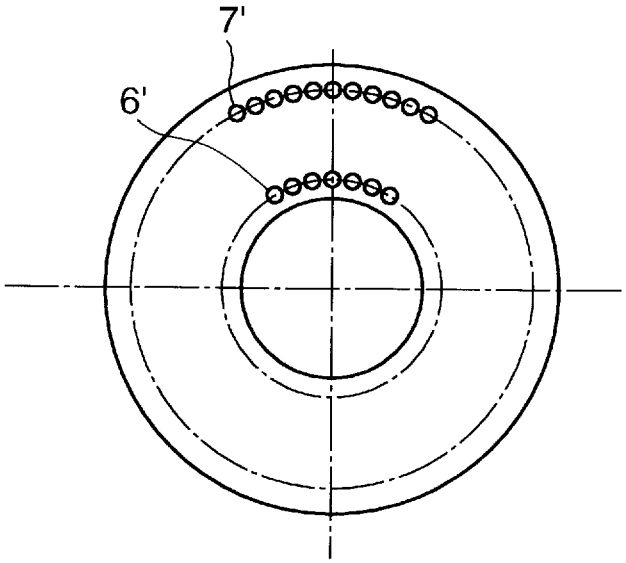
FIG. 9 (PRIOR ART)
FIG. 9 is a front elevational view of the apparatus of FIG. 8.

FIGS. 1–3 illustrate an apparatus and test results according to a first embodiment of the present invention; FIGS. 4 and 5 illustrate an apparatus according to a second embodiment of the present invention; and FIGS. 6 and 7 illustrate an apparatus according to third embodiment of the present invention. Portions common or similar to all of the embodiments of the present invention are denoted with the same reference numerals throughout all of the embodiments of the present invention.

First, portions common or similar to all of the embodiments of the present invention will be explained with reference to, for example, FIG. 1.

As illustrated in FIG. 1, a rotary atomizing electrostatic coating apparatus includes an atomizing head 1 for atomizing paint which has an axis of rotation and is rotatable about the axis of rotation, an air motor 2 for driving or rotating the atomizing head 1, a cover (housing) 3 for housing the air motor 2 therein and made from synthetic resin, a paint feed tube 4 for supplying paint to the atomizing head 1, and an air cap 5, disposed on a front side of the housing 3. The apparatus further includes a plurality of shaping air nozzles 6 formed in the air cap 5, for expelling shaping air and accelerating paint particles dispersed from the atomizing head 1 toward a workpiece to be coated, and a plurality of pattern control air nozzles 7, disposed radially outside the shaping air nozzles, for expelling pattern control air to thereby control the flow pattern of the shaping air within a variable range of the shaping air flow pattern.

The shaping air nozzles 6 are arranged on a first circle having its circle center on the axis of rotation of the atomizing head 1. The pattern control air nozzles 7 are arranged on a second circle located outside the first circle and having the same circle center as the first circle.

Each shaping air nozzle 6 has an axis inclined (or twisted) by a predetermined angle (more particularly, 30–40 degrees) from a line parallel to the axis of rotation of the atomizing head 1 and passing through a center of the nozzle 6 in a direction perpendicular to a radial direction of the atomizing head so that a shaping air flow pattern is spread in a direction away from the shaping air nozzle.

Each of pattern control air nozzles 7 is disposed so as to intersect the shaping air flow pattern when extended in a frontward direction of each pattern control air nozzle 7 whereby a configuration of the shaping air flow pattern is controllable.

Control of the shaping air and the control air is conducted as follows:

Paint particles atomized and dispersed radially outwardly from the atomizing head 1 are accelerated by the shaping air toward a workpiece to be coated located in front of the coating apparatus. Since the direction of the shaping air expelled from the shaping air nozzle is inclined from the line parallel to the axis of rotation of the atomizing head 1, the shaping air flow pattern is spread. In the case where an area of the object to be coated is wide such as a general surface of an automobile body, the coating is conducted using the shaping air only without using the pattern control air. In the case where an area of the object to be coated is narrow and small, the coating is conducted using both the shaping air and the pattern control air. In this way, overspraying of paint will be prevented so that consumption of paint is minimized. The size of the paint flow pattern is controlled by controlling a pressure of the shaping air and a pressure of the pattern control air so as to match a size of the object to be coated.

Portions unique to each embodiment of the present invention will now be explained.

With a first embodiment of the present invention, as illustrated in FIG. 1–3, the pattern control air nozzles (outer nozzles) 7 are located on a rear side of the shaping air nozzles (inner nozzles) 6 in the range of 3 mm to 100 mm from the shaping air nozzles in the axial direction of the atomizing head. Further, the pattern control air nozzles 7 are located inside a circle having a diameter three times a diameter d of the atomizing head in the radial direction of the atomizing head.

The reasons for the above-described locational conditions are as follows:

FIG. 2 illustrates a relationship, obtained in tests, between a paint adhesion state and an axial distance L between the shaping air nozzles 6 and the pattern control air nozzles 7 when coating was conducted using both the shaping air and the pattern control air. In FIG. 2, positive L means that the pattern control air nozzles 7 are located on the rear side of the shaping air nozzles 6, and negative L means that the pattern control air nozzles 7 are located on the front side of the shaping air nozzles 6. The magnitude of the paint adhesion to the cap and the atomizing head is classified into three levels ①, ② and ③. In this instance, level ① means the state where paint adhered to the surface of the cap and the atomizing head thinly and entirely or locally so that the adhering paint did not separate from the surfaces to fall onto the workpiece to be coated; level ② means the state where paint adhered to the surfaces of the cap and the atomizing head rather thickly so that when touched or vibrated the adhering paint separated from the surfaces to fall onto the workpiece; and level ③ means the state where paint adhered to the surface of the cap and the atomizing head very thickly so that even during normal coating the adhering paint separated from the surfaces to fall onto the workpiece.

As can be seen from FIG. 2, in the case where the pattern control air nozzles 7 were located on the front side of the shaping air nozzles 6, the magnitude of paint adhesion was great so that coating troubles would easily occur. In the case where the pattern control air nozzles were located too far (further than 100 mm) from the shaping air nozzles 6 on the rear side of the shaping air nozzles 6, the pattern varying ability of the pattern control air decreased too much so that there was no meaning in provision of the pattern control air nozzles. Therefore, the pattern control air nozzles 7 should be located within the range of 3 mm to 100 mm from the shaping air nozzles 6 on the rear side of the shaping air nozzles.

FIG. 3 illustrates a relationship, obtained in tests, between a paint adhesion state and a diameter D of a circle on which the pattern control air nozzles 7 were located when coating was conducted using both the shaping air and the pattern control air. The magnitude of the paint adhesion is classified into three levels ①, ② and ③ discussed above. As can be seen from FIG. 3, when the diameter D was selected to be greater than three times the diameter of the circle on which the shaping air nozzles were arranged (d was nearly equal to the circle on which the shaping air nozzles were arranged), the paint adhesion was at level ③ where a coating problem easily happened. Therefore, the diameter on which the pattern control air nozzles 7 are arranged should be equal to or smaller than a diameter three times the diameter of the outermost portion of the atomizing head 1. However, d is greater than D, because the circle on which the pattern control air nozzles 7 are arranged is located radially outside the circle on which the shaping air nozzles 6 are arranged.

The pattern control air nozzles 7 are formed in the air cap 5. To prevent the air flow around the air cap from generating vortices, as illustrated in FIG. 1, corner portions of the air cap 5 should be rounded, and a connecting surface connecting a surface where the shaping air nozzles 6 are open and a surface where the pattern control air nozzles 7 are open should be inclined from a line parallel to the axis of rotation of the atomizing head by angle θ (more than 10 degrees). The connecting surface is inclined radially inwardly in the frontward direction.

In the first embodiment of the present invention, vortices are prevented from being generated around the cap and the atomizing head. More particularly, when the pattern control air is not being expelled, since the surface where the pattern control air nozzles 7 are open is located on the rear side of the surface where the shaping air nozzles 6 are open, air can easily flow to the shaping air from the obliquely rear side of the shaping air. When the pattern control air is being expelled, the pattern control air flows easily to the shaping air from the obliquely rear side of the shaping air. As a result, whether or not pattern control air is being expelled, vortices around the shaping air is prevented from being generated so that paint adhesion to the air cap and the atomizing head due to vortices generated around the shaping air and coating troubles due to dropping of the adhering paint onto the workpiece are effectively prevented.

With a second embodiment of the present invention, as illustrated in FIGS. 4 and 5, at least one air passable opening 8 (hereinafter, opening) for permitting air to pass therethrough is formed radially between the shaping air nozzles 6 formed in the air cap 5 and the pattern control air nozzles 7 formed in the air cap 5.

An air passage is formed so as to connect a front surface of the air cap 5 and a side surface (cylindrical outside surface) of the resin cover (or housing) 3, and one end of the air passage open to the front surface of the air cap constitutes the opening 8. As illustrated in FIG. 5, a plurality of (four in FIG. 5) openings 8 are formed.

The above-described structure according to the second embodiment of the present invention may be added to the structure according to the first embodiment of the present invention above discussed or may be applied to a structure which does not have the arrangement of the pattern control air nozzles on the side of the shaping air nozzles by 3–100 mm and the location of the pattern control air nozzles inside the circle having the diameter three times of the diameter of the atomizing head but has the same structure with respect to the remaining portions as those of the structure of the first embodiment of the present invention.

Whether or not the pattern control air is being expelled, air is easily suctioned through the opening 8 to a negative pressure generating portion (particularly, a portion between the shaping air flow and the pattern control air flow). As a result, an air flow accompanying the shaping air flow is easily formed so that vortices are unlikely to be generated around the shaping air and coating troubles are suppressed.

With a third embodiment of the present invention, as illustrated in FIGS. 6 and 7, opening 8 for permitting air to pass therethrough is formed radially between the shaping air nozzles 6 formed in the air cap 5 and the pattern control air nozzles 7.

The pattern control air nozzles 7 are formed in a pattern control air nozzle ring 9 which is a hollow ring. The ring 9 is radially spaced from the air cap 5 and is supported from the air cap 5 by a support member 10. A gap between the ring 9 and the air cap 5 constitutes the opening 8.

Whether or not the pattern control air is being expelled, air is easily suctioned through the opening 8 to a negative pressure generating portion (particularly, a portion between the shaping air flow and the pattern control air flow). As a result, an air flow accompanying the shaping air flow is easily formed so that vortices are unlikely to be generated around the shaping air and coating troubles are suppressed.

According to the present invention, the following technical advantages are obtained:

First, since the pattern control air nozzles are spaced from the shaping air nozzles by 3 to 100 mm in a rear direction of the shaping air nozzles and are located inside a circle having a diameter three times the diameter of the atomizing head, and air flow accompanying the shaping air flow is easily formed around the shaping air flow, so that vortices or turbulence are prevented from being generated around the shaping air flow and paint adhesion to the air cap and the atomizing head due to the vortices or turbulence is effectively prevented.

Second, in the case where the connecting surface connecting the surface where the shaping air nozzles are open and the surface where the pattern control air nozzles are open is inclined from a line parallel to the axis of rotation of the atomizing head, generation of vortices around the air cap is more effectively suppressed.

Third, since the opening is provided radially between the shaping air nozzles and the pattern control air nozzles, air introduction to a negative pressure generating portion through the opening is permitted so that an air flow accompanying the shaping air flow is easily formed and adhesion of paint to the air cap and the atomizing head is effectively prevented.

Although the present invention has been described with reference to specific exemplary embodiments, it will be appreciated by those skilled in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. A rotary atomizing electrostatic coating apparatus comprising:

a housing;

an atomizing head disposed on a front side of said housing, said atomizing head having an axis of rotation and being rotatable about said axis of rotation;

an air motor, disposed within said housing, constructed and arranged to drive said atomizing head;

an air cap disposed on said front side of said housing, said air cap having a plurality of shaping air nozzles formed therein, said plurality of shaping air nozzles being arranged on a first circle having a circle center thereof on said axis of rotation of said atomizing head; and a plurality of pattern control air nozzles arranged on a second circle having a circle center thereof on said axis of rotation of said atomizing head and having a larger diameter than said first circle, wherein said plurality of pattern control air nozzles are disposed so as to be spaced away from said plurality of shaping air nozzles by 3–100 mm on a rear side of said plurality of shaping air nozzles in an axial direction of said atomizing head and to be located inside a circle having a diameter three times a diameter of said atomizing head in a radial direction of said atomizing head.

2. An apparatus according to claim 1, wherein said plurality of pattern control air nozzles are formed in said air cap.

3. An apparatus according to claim 1, wherein each of said plurality of shaping air nozzles is inclined from a line parallel to said axis of rotation of said atomizing head, whereby a shaping air flow pattern formed by shaping air expelled from said plurality of shaping air nozzles is spread in a direction away from said plurality of shaping air nozzles.

4. An apparatus according to claim 3, wherein each of said pattern control air nozzles are directed to intersect said shaping air flow pattern when extended in a frontward direction of said pattern control air nozzles.

5. An apparatus according to claim 2, wherein said air cap includes a first front surface portion where said plurality of shaping air nozzles are open, a second front surface portion where said plurality of pattern control air nozzles are open, and a connecting surface connecting said first front surface portion and said second front surface portion, said connecting surface being inclined from a line parallel to said axis of rotation of said atomizing head.

6. A rotary atomizing electrostatic coating apparatus comprising:

a housing:

an atomizing head disposed on a front side of said housing, said atomizing head having an axis of rotation and being rotatable about said axis of rotation;

an air motor, disposed within said housing, constructed and arranged to drive said atomizing head;

an air cap disposed on said front side of said housing, said air cap having a plurality of shaping air nozzles formed therein, said plurality of shaping air nozzles being arranged on a first circle having a circle center thereof on said axis of rotation of said atomizing head: and a plurality of pattern control air nozzles arranged on a second circle having a circle center thereof on said axis of rotation of said atomizing head and having a larger diameter than said first circle, said coating apparatus defining at least one opening that permits air to pass therethrough and being formed radially between said plurality of shaping air nozzles and said plurality of pattern control air nozzles, wherein said plurality of pattern control air nozzles are disposed so as to be spaced away from said plurality of shaping air nozzles by 3–100 mm on a rear side of said plurality of shaping air nozzles in an axial direction of said atomizing head and to be located inside a circle having a diameter three times a diameter of said atomizing head on a radial direction of said atomizing head.

7. An apparatus according to claim 6, wherein said air cap has a front surface and said housing has an outside side surface, said housing defining at least one air passage therein extending between said front surface of said air cap and said outside side surface of said housing, said air passage having an end opening at said front surface of said air cap constructed and arranged to provide said at least one opening.

8. An apparatus according to claim 6, further comprising a pattern control air nozzle ring spaced away from and located radially outside said air cap with a gap between said ring and said air cap, said plurality of pattern control air nozzles being formed in said ring, said gap between said ring and said air cap constructed and arranged to provide said at least one opening.

9. A rotary atomizing head electrostatic coating apparatus comprising:

a housing;

an atomizing head disposed on a front side of said housing, said atomizing head having an axis of rotation and being rotatable about said axis of rotation;

an air motor, disposed within said housing, constructed and arranged to drive said atomizing head;

an air cap disposed on said front side of said housing, said air cap having a plurality of shaping air nozzles formed therein, said plurality of shaping air nozzles being arranged on a first circle having a circle center thereof on said axis of rotation of said atomizing head; and a plurality of pattern control air nozzles arranged on a second circle having a circle center thereof on said axis of rotation of said atomizing head and having a larger diameter than said first circle, wherein at least one opening for permitting air to pass therethrough is formed radially between said plurality of shaping air nozzles and said plurality of pattern control air nozzles.

10. An apparatus according to claim 9, wherein said air cap has a front surface and said housing has an outside side surface, said housing defining at least one air passage therein extending between said front surface of said air cap and said outside side surface of said housing, said air passage having an end opening at said front surface of said air cap constructed and arranged to provide said at least one opening.

11. An apparatus according to claim 9, further comprising a pattern control air nozzle ring spaced away from and located radially outside said air cap with a gap between said ring and said air cap, said plurality of pattern control air nozzles being formed in said ring, said gap between said ring and said air cap constructed and arranged to provide said at least one opening.

* * * * *